US011306258B2

(12) United States Patent
Al-Ghrami et al.

(10) Patent No.: US 11,306,258 B2
(45) Date of Patent: Apr. 19, 2022

(54) ENHANCED LIGHT OLEFIN YIELD VIA STEAM CATALYTIC DOWNER PYROLYSIS OF HYDROCARBON FEEDSTOCK

(71) Applicant: SAUDI ARABIAN OIL COMPANY, Dhahran (SA)

(72) Inventors: Musaed Salem Al-Ghrami, Dhahran (SA); Wei Xu, Dhahran (SA); Aaron Chi Akah, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/942,350

(22) Filed: Jul. 29, 2020

(65) Prior Publication Data

US 2020/0354637 A1 Nov. 12, 2020

Related U.S. Application Data

(62) Division of application No. 15/955,328, filed on Apr. 17, 2018, now Pat. No. 10,767,117.

(Continued)

(51) Int. Cl.
*C10G 11/00* (2006.01)
*C10G 11/20* (2006.01)

(Continued)

(52) U.S. Cl.
CPC ..... *C10G 11/20* (2013.01); *C10G 9/28* (2013.01); *C10G 11/16* (2013.01); *C10G 11/182* (2013.01);

(Continued)

(58) Field of Classification Search
CPC ..... B01J 8/003; B01J 8/12; B01J 8/15; B01J 8/18; B01J 8/1827; B01J 8/24; B01J 8/26;

(Continued)

(56) References Cited

U.S. PATENT DOCUMENTS 2,029,657 A 2/1936 Frey et al.
2,852,440 A 9/1958 Smith et al.

(Continued)

FOREIGN PATENT DOCUMENTS

EP 0236055 A2 9/1987
EP 0305720 A2 3/1989

(Continued)

OTHER PUBLICATIONS

International Search Report and Written Opinion for International Application No. PCT/US2018/029325, dated Jul. 3, 2018 (pp. 1-11).

(Continued)

*Primary Examiner* — Prem C Singh
*Assistant Examiner* — Brandi M Doyle
(74) *Attorney, Agent, or Firm* — Bracewell LLP; Constance G. Rhebergen

(57) ABSTRACT

Systems and methods for steam and catalytic cracking of a hydrocarbon inlet stream comprising hydrocarbons. Systems and methods can include a catalyst feed stream, where the catalyst feed stream comprises a fluid and a heterogeneous catalyst, the heterogeneous catalyst operable to catalyze cracking of the hydrocarbons on surfaces of the heterogeneous catalyst a steam feed stream, where the steam feed stream is operable to effect steam cracking of the hydrocarbons, and where the steam feed stream decreases coking of the heterogeneous catalyst; and a downflow reactor, where the downflow reactor is operable to accept and mix the hydrocarbon inlet stream, the catalyst feed stream, and the steam feed stream, where the downflow reactor is operable to produce light olefins by steam cracking and catalytic cracking, and where the downflow reactor is operable to allow the heterogeneous catalyst to flow downwardly by gravity.

11 Claims, 1 Drawing Sheet

Related U.S. Application Data

(60) Provisional application No. 62/489,681, filed on Apr. 25, 2017.

(51) Int. Cl.

| | |
|---|---|
| ***C10G 11/18*** | (2006.01) |
| ***C10G 51/06*** | (2006.01) |
| ***C10G 11/16*** | (2006.01) |
| ***C10G 9/28*** | (2006.01) |

(52) U.S. Cl.
CPC ..... *C10G 51/06* (2013.01); *C10G 2300/1048* (2013.01); *C10G 2300/1085* (2013.01); *C10G 2300/708* (2013.01); *C10G 2400/20* (2013.01)

(58) Field of Classification Search
CPC ..... C10G 11/20; C10G 11/182; C10G 51/06; C10G 11/16; C10G 9/28; C10G 2400/20; C10G 2300/708; C10G 2300/1085; C10G 2300/1048
See application file for complete search history.

(56) References Cited

U.S. PATENT DOCUMENTS

| | | | | |
|---|---|---|---|---|
| 2,965,454 | A | 12/1960 | Harper | |
| 3,074,878 | A | 1/1963 | Pappas | |
| 3,835,029 | A * | 9/1974 | Larson | B01J 8/0015 208/113 |
| 4,419,221 | A | 12/1983 | Castagnos et al. | |
| 4,797,262 | A | 1/1989 | Dewitz | |
| 4,980,053 | A | 12/1990 | Li et al. | |
| 5,232,675 | A | 8/1993 | Shu et al. | |
| 5,326,465 | A | 7/1994 | Vongoing et al. | |
| 5,344,554 | A | 9/1994 | Pontier et al. | |
| 5,380,690 | A | 1/1995 | Zhicheng et al. | |
| 5,462,652 | A | 10/1995 | Wegerer | |
| 5,589,139 | A | 12/1996 | Zinke et al. | |
| 5,670,037 | A | 9/1997 | Zaiting et al. | |
| 6,420,621 | B2 | 7/2002 | Sha et al. | |
| 6,656,346 | B2 | 12/2003 | Ino et al. | |
| 7,087,154 | B2 | 8/2006 | Pinho et al. | |
| 7,479,218 | B2 | 1/2009 | Letzsch | |
| 8,877,042 | B2 | 11/2014 | Dean et al. | |
| 9,434,892 | B2 | 9/2016 | Pradeep et al. | |
| 9,452,404 | B2 | 9/2016 | Marri et al. | |
| 9,458,394 | B2 | 10/2016 | Dean et al. | |
| 2002/0014438 | A1 | 2/2002 | Swan, III | |
| 2004/0054247 | A1 | 3/2004 | Powers | |
| 2004/0124124 | A1 * | 7/2004 | Pinho | B01J 8/003 208/113 |
| 2013/0343956 | A1 * | 12/2013 | Al-Thubaiti | B01J 8/26 422/110 |
| 2015/0152027 | A1 | 6/2015 | Shafi et al. | |
| 2015/0375218 | A1 | 12/2015 | Koseoglu et al. | |

FOREIGN PATENT DOCUMENTS

| | | |
|---|---|---|
| EP | 3315179 A1 | 5/1989 |
| EP | 0909804 A2 | 4/1999 |

OTHER PUBLICATIONS

Corma et al., "Steam catalytic cracking of naphtha over ZSM-5 zeolite for production of propene and ethene: Micro and macroscopic implications of the presence of steam", Applied Catalysis A: General, 2012, pp. 220-235, vols. 417-418, Elsevier.

* cited by examiner

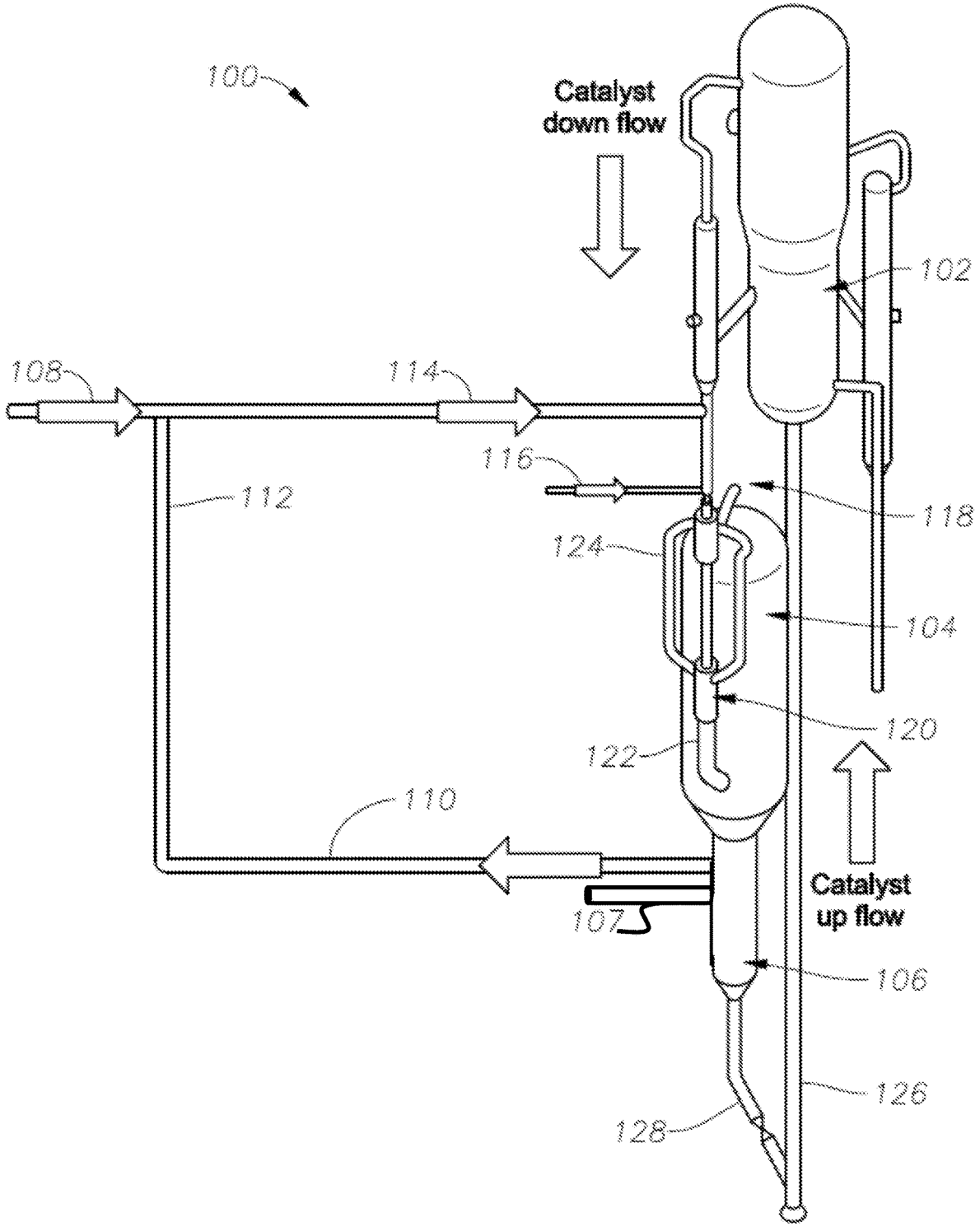
100
Catalyst down flow
102
108
114
116
112
118
124
104
120
122
110
Catalyst up flow
107
106
126
128

ENHANCED LIGHT OLEFIN YIELD VIA STEAM CATALYTIC DOWNER PYROLYSIS OF HYDROCARBON FEEDSTOCK

PRIORITY

The present application is a divisional application of and claims priority to and the benefit of U.S. patent application Ser. No. 15/955,328, filed Apr. 17, 2018, which itself claims priority to and the benefit of U.S. Prov. App. No. 62/489,681, filed Apr. 25, 2017, the entire disclosures of which are incorporated here by reference.

BACKGROUND

Field

Embodiments of the disclosure relate to cracking hydrocarbon feedstocks. In particular, embodiments of the disclosure relate to cracking hydrocarbon feedstocks with catalytic cracking and steam cracking (pyrolysis) in a fluidized catalytic downflow reactor.

Description of the Related Art

Both catalytic and non-catalytic techniques are industrially applied for the conversion of various hydrocarbon feedstocks to valuable chemical components. For example, steam cracking (non-catalytic cracking) is applied to hydrocarbon feedstocks to produce ethylene as a product, and fluid catalytic cracking (FCC) (catalytic cracking) is applied to hydrocarbon feedstocks to produce gasoline as a product. "Light" olefins such as ethylene and propylene are currently produced from crude oil, natural gas fractions such as ethane, liquefied petroleum gas (LPG), naphtha, gas oils, and residues by these two main processes: steam cracking and fluidized catalytic cracking.

Propylene and other light olefins are obtained as by-products from both steam cracking and FCC. Certain steam crackers used in industry use ethane as a feedstock, and although ethane-based steam crackers are expected to be a supplier of olefins such as propylene, there likely will be a gap in supply as less olefins, especially propylene, are produced from ethane-based feed in the future. The continuous rise in demand for light olefins other than ethylene, such as for example propylene, has led to the reconfiguration of conventional FCC processes to produce more desirable chemicals.

However, known cracking methods still cannot produce light-fraction olefins at sufficient selectively levels. For example, high-temperature cracking reactions will result in a concurrent thermal cracking of heavy-fraction oils, thereby increasing the yield of dry gases (such as for example methane) from said oils. A short contact time of hydrocarbon feedstock with a catalyst will cause a decrease in production of light-fraction olefins, and instead light-fraction paraffins will be produced due to inhibition of a hydrogen transfer reaction, and the increased conversion of heavy-fraction oils to light-fraction oils is prevented.

SUMMARY

Applicant has recognized that there is a need for efficient cracking apparatus, methods, and systems for selectively producing light olefins, such as for example ethylene and propylene, from hydrocarbon feedstocks. The disclosure presents apparatus, methods, and systems in which the synergistic effects of catalytic cracking and steam cracking are applied in unison to convert hydrocarbon feedstock to light olefins, for example ethylene and propylene, using fluidized catalytic pyrolysis (FCP), also referred to as fluidized catalytic steam cracking.

The disclosure includes processes and methods that apply a synergistic effect created through the use of steam cracking, catalytic cracking, and a downer high-severity fluid catalytic cracking (HS-FCC) reactor configuration in order to maximize the yield of light olefins, such as for example ethylene and propylene, using a variety of hydrocarbon feedstocks, including crude oil for example. The phrase "light olefins" as used here refers generally to $C_2$-$C_4$ olefins. The conversion to light olefins will depend on the composition of the hydrocarbon feedstock, and in some embodiments is expected to be at least 30% with a total yield of ethylene and propylene together of at least 20%. The steam catalytic cracking process will be operated such that approximately 20% to 70% of the feed is selectively converted into mainly light olefins such as ethylene and propylene.

Deficiencies in prior art systems and methods, such as FCC and steam cracking, include: (I) rapid catalyst deactivation due to coke formation and contaminations from heavy metals or other catalyst contaminants in crude oil and (II) different cracking products of the hydrocarbons within a wide boiling point range of crude oil. Embodiments of systems and methods of the present disclosure apply steam to assist catalytic cracking to increase the yield of light olefins. At the same time, steam will act as diluent to reduce coke formation and hydrocarbon deposition on the catalyst. Systems and methods of the present disclosure will provide greater hydrocarbon feed conversion to light olefins for increased light olefin yield and selectivity, which cannot be obtained from catalytic cracking only.

More specifically, an FCC catalyst in the presence of steam will be used in high-severity downer catalytic cracking systems to enhance the production of light olefins such as ethylene and propylene under lesser temperatures than those normally required by non-catalytic steam cracking processes.

Therefore, embodiments of the disclosure include a system for steam and catalytic cracking of a hydrocarbon inlet stream comprising hydrocarbons. The system includes a catalyst feed stream, where the catalyst feed stream comprises a fluid and a heterogeneous catalyst, the heterogeneous catalyst operable to catalyze cracking of the hydrocarbons on surfaces of the heterogeneous catalyst; a steam feed stream, where the steam feed stream is operable to effect steam cracking of the hydrocarbons, and where the steam feed stream decreases coking of the heterogeneous catalyst; and a downflow reactor, where the downflow reactor is operable to accept and mix the hydrocarbon inlet stream, the catalyst feed stream, and the steam feed stream, where the downflow reactor is operable to produce light olefins by steam cracking and catalytic cracking, and where the downflow reactor is operable to allow the heterogeneous catalyst to flow downwardly by gravity.

In some embodiments of the system, the downflow reactor operates in a temperature range between about 500° C. to about 700° C. In other embodiments of the system, the system includes a catalyst hydrocarbon stripper with structured packing, where the catalyst hydrocarbon stripper is operable to remove hydrocarbons adsorbed to the heterogeneous catalyst by applying steam. Still in other embodiments of the system, the steam feed stream comprises a recycle steam stream, where the recycle steam stream comprises steam used in the catalyst hydrocarbon stripper with structured packing to remove hydrocarbons adsorbed to the heterogeneous catalyst. In yet other embodiments, the system further includes a catalyst regenerator operable to regenerate spent heterogeneous catalyst through combustion of coke disposed on the heterogeneous catalyst.

Still in other embodiments, the catalyst feed stream comprises new, unused heterogeneous catalyst and regenerated catalyst from the catalyst regenerator. In certain embodiments, a yield of light olefins from a hydrocarbon inlet stream is at least about 30%. Still in other embodiments, the system is operable to accept the steam feed stream when the steam feed stream is greater than about 3% by weight of the hydrocarbon inlet stream. In other embodiments, the system is operable to accept the steam feed stream when the steam feed stream is between about 5% by weight and about 15% by weight of the hydrocarbon inlet stream. Still in other embodiments, the system is operable to accept the steam feed stream when the steam feed stream is about 10% by weight of the hydrocarbon inlet stream.

Additionally disclosed is a method for steam and catalytic cracking of hydrocarbons, and the method includes the steps of supplying a catalyst feed, where the catalyst feed comprises a fluid and a heterogeneous catalyst, the heterogeneous catalyst operable to catalyze cracking of the hydrocarbons on surfaces of the heterogeneous catalyst; supplying steam, where the steam is operable to effect steam cracking of the hydrocarbons, and where the steam is operable to decrease coking of the heterogeneous catalyst; and mixing the hydrocarbons, the catalyst feed, and the steam to produce light olefins by steam cracking and catalytic cracking simultaneously, where the heterogeneous catalyst flows downwardly by gravity.

In some embodiments of the method, the step of mixing the hydrocarbons further comprises the step of operating a downflow reactor in a temperature range between about 500° C. to about 700° C. In other embodiments, the method further comprises the step of removing hydrocarbons adsorbed to the heterogeneous catalyst by applying steam after the step of mixing the hydrocarbons, the catalyst feed, and the steam to produce light olefins. Still in other embodiments, the method further includes the step of recycling the steam used in the step of removing hydrocarbons adsorbed to the heterogeneous catalyst for use in the step of supplying steam. In yet other embodiments, the method includes the step of regenerating the heterogeneous catalyst through combustion of coke disposed on the heterogeneous catalyst. Still in other embodiments, the catalyst feed comprises new, unused heterogeneous catalyst and regenerated catalyst.

Still in other embodiments of the method, a yield of light olefins from a hydrocarbon inlet stream is at least about 30%. In some embodiments, the step of supplying steam comprises supplying steam feed at greater than about 3% by weight of the hydrocarbons. In certain embodiments, the step of supplying steam comprises supplying steam feed at between about 5% by weight and about 15% by weight of the hydrocarbons. Still in other embodiments, the step of supplying steam comprises supplying steam feed at about 10% by weight of the hydrocarbons.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

FIG. 1 is a schematic showing one layout for an apparatus and method applying fluidized catalytic pyrolysis (FCP).

DETAILED DESCRIPTION

So that the manner in which the features and advantages of the embodiments of apparatus, systems, and methods for fluidized catalytic pyrolysis, as well as others, which will become apparent, may be understood in more detail, a more particular description of the embodiments of the present disclosure briefly summarized previously may be had by reference to the various embodiments, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Referring now to FIG. 1, a schematic is pictured showing one layout for an apparatus and method applying fluidized catalytic pyrolysis (FCP). FCP system 100 includes a catalyst regenerator 102, a downflow reactor 104, and a catalyst stripper with structured packing 106. FCP system 100 further includes a steam supply line 108, a steam outlet line 110, a steam recycle line 112, which is optional, and a steam inlet line 114, which combines steam from steam supply line 108 and steam from optional steam recycle line 112. Hydrocarbon feedstock, such as for example crude oil in addition to or alternative to other hydrocarbons, is fed to FCP system 100 by feed injection line 116, and products, such as for example light olefins including ethylene and propylene, exit FCP system 100 by product outlet line 118.

FCP system 100 further includes a gas-solid separator 120, such as for example a cyclone separator, to separate gaseous components, such as for example gaseous products including light olefins such as ethylene and propylene, from solid catalyst. Catalyst and products are separated using one or more cyclone separators, or similar separators, with solid catalyst particles being sent to the catalyst regenerator 102, while products consisting of hydrocarbons pass from the system 100 and are sent downstream for separation and collection. A combined downflow reactor inlet line 122 provides steam, catalyst, and hydrocarbon feedstock to downflow reactor 104. In downflow reactor 104, catalytic cracking and steam cracking (pyrolysis) proceed synergistically and in unison to produce light olefins from hydrocarbon feedstock. Light olefins (gases) exit via gaseous outflow lines 124 and product outlet line 118.

Hydrocarbon feedstock from feed injection line 116 is charged to a mixing zone (for atomization of the feed) where it is mixed with high pressure steam from steam inlet line 114 and hot regenerated catalyst from the catalyst regenerator 102. High pressure steam disperses the feedstock, and a mixture of steam, hydrocarbons, and catalyst (either or both regenerated catalyst and new catalyst) moves downwards through a reaction zone in downflow reactor 104 where hydrocarbon cracking reactions take place. A mixture of steam, spent catalyst, and hydrocarbon products from the reaction zone enters a gas solid separation zone in gas-solid separator 120. Spent solid catalyst is separated from gases by centrifugal forces, and the catalyst flows downwardly by gravity to an upper section of the catalyst stripper with structured packing 106.

Hydrocarbon product gases, such as ethylene and propylene, are recovered in a product recovery section from gas-solid separator 120. For the spent catalyst, high pressure steam is injected into catalyst stripper with structured packing 106 to strip heavy hydrocarbons adsorbed on catalyst particles. Vapors of heavy hydrocarbons and unreacted feed from the spent catalyst are withdrawn from the catalyst stripper with structured packing 106 and sent to product recovery. Spent catalyst is then transferred to the catalyst regenerator 102 from the catalyst stripper with structured packing 106.

The downward arrow labeled "catalyst down flow" pointing downwardly from catalyst regenerator 102 to catalyst stripper with structured packing 106 shows the general flow of activated catalyst (optionally new or regenerated or both) downwardly, with gravity, through the system. The upward pointing arrow labeled "catalyst up flow" shows the general flow of deactivated, coked catalyst in catalyst return line 126 from catalyst stripper bottoms line 128 to catalyst regenerator 102. Upward gas flow, such as for example air, through catalyst return line 126 carries deactivated, coked catalyst particles from catalyst stripper bottoms line 128 to catalyst regenerator 102.

In FCP system 100, an amount of steam is applied in downflow reactor 104 to enhance light olefin yield from hydrocarbon feedstock and to reduce the coking rate of solid catalyst. The catalyst system applies a suitable high olefinic catalyst containing zeolite, such as for example zeolite socony mobil-5™ (ZSM-5). ZSM-5 is an aluminosilicate zeolite belonging to the pentasil family of zeolites, $Na_nAl_nSi_{96-n}O192.16H_2O$ ($0<n<27$), used in the petroleum industry as a heterogeneous catalyst. Other suitable catalysts include faujasite, such as faujasite-Na, faujasite-Mg and faujasite-Ca which share the same basic formula: $(Na_2,Ca,Mg)_{3.5}[Al_7Si_{17}O_{48}].32(H_2O)$ by varying the amounts of sodium, magnesium and calcium, and BEA zeolites (zeolite beta) supported on refractory oxides such as alumina.

One problem associated with the use of steam is hydrothermal stability of the catalyst, and catalysts used in embodiments of the present disclosure are suitable or operable to withstand hydrothermal conditions which facilitate catalyst degradation in prior art systems. Catalysts used in embodiments of the present disclosure are utilized in fluidized, rather than packed, beds enabling greater conversion to light olefins. Steam in embodiments of the present invention is used not only for atomization of the hydrocarbon feed, fluidization of catalysts, and stripping of hydrocarbons from spent catalyst, but is also advantageously used in an amount operable to effect steam cracking of hydrocarbons simultaneous with catalytic cracking on a catalyst surface. Steam can be injected to downflow reactor 104 before, simultaneous with, or before and simultaneous with a hydrocarbon feed and catalyst. Steam in embodiments of the present disclosure is not used merely for stripping spent catalyst, but instead positively impacts the product distribution toward light olefins by causing steam cracking reactions in the downflow reactor 104.

Steam is used for pyrolysis as well as to reduce coke formation on the catalyst. Fresh steam can be introduced to downflow reactor 104 with fresh catalyst injection from catalyst regenerator 102. In addition, steam used in the catalyst stripper with structured packing 106 to clean the catalyst of remaining hydrocarbons adsorbed on the catalyst can be recycled to the downflow reactor 104 by steam recycle line 112. In some embodiments, the preferred operation temperature of FCP system 100 is in the range of about 500° C. to about 700° C. The temperature range used in prior art steam cracking is about 750° C. to about 900° C., but in embodiments of the present disclosure, the temperature is about 50° C. to about 400° C. less than what is used in steam cracking.

In FCP system 100, hydrocarbon feedstock, such as for example petroleum feedstock, is preheated and mixed with steam and then fed to downflow reactor 104, where it intimately mixes with and contacts hot catalyst from catalyst regenerator 102. Preheating steam is used to atomize the hydrocarbon feedstock and reduce the viscosity of the feed before being sent to the reactor. Prior to entering downflow reactor 104, additional steam is injected to make up the total quantity of steam required for steam cracking (pyrolysis) reactions, in addition to catalytic cracking. In embodiments of the present disclosure, the amount of steam fed to downflow reactor 104 is greater than about 3 weight % of the hydrocarbon feed, in some embodiments the amount of steam fed to downflow reactor 104 is greater than about 5 weight % of the hydrocarbon feed, in some embodiments the amount of steam fed to downflow reactor 104 is greater than about 10 weight % of the hydrocarbon feed, and in some embodiments the amount of steam fed to downflow reactor 104 is between about 5 weight % and about 15 weight %, for example about 10 weight %, of the hydrocarbon feed.

The hydrocarbon feedstock is catalytically cracked in the presence of steam while steam cracking also simultaneously takes place, and spent catalyst containing coke is transferred by gravity to catalyst stripper with structured packing 106. Deposited hydrocarbons on the catalyst particles (other than coke) are stripped with steam, and the partially-clean, but still-coked catalyst is transferred to the catalyst regenerator 102 where air, in addition to or alternative to pure oxygen, is introduced to combust coke on the catalyst particles. Hot, regenerated catalyst, optionally with or without fresh catalyst makeup, is sent to downflow reactor 104 via a controlled circulation rate to achieve heat balance of the system. In some embodiments, additional steam can be injected into the catalyst stripper with structured packing 106 by way of stripper steam inlet 107.

In FCC operations, ideally at steady state only the amount of coke necessary to meet the reactor energy demands is produced, and then the coke is combusted in a regenerator. Each FCC unit has a certain coke burning capability which can be used as a basis to either increase or decrease the severity to the desired level based on the feedstock. One goal is to produce enough coke to sustain feed conversion and subsequent downstream processes such as fractionation. Adjusting the catalyst circulation rate, the feed and product circulation rates, as well as other parameters, allows for suitable conversion of the hydrocarbon feedstock to olefins.

HS-FCC processes have specific process conditions including downflow, high reaction temperature, short contact time, and high catalyst/oil ratio. In embodiments of the present disclosure, regenerator combustion gases provide lift for the upward flow of regenerated catalyst. Combustion gases lift regenerated catalyst in the upper section of a turbulent-phase fluidized bed to an acceleration zone and then to a riser-type lift line. Regenerated catalyst can then be carried to a catalyst hopper located at the end of the lift line.

In embodiments of the present disclosure, a down-flow reactor system is applied in an HS-FCC process to minimize back-mixing in the reactor in order to narrow the residence time distribution. Thus, light olefin production is maximized with minimum dry gas yield (such as for example methane). Addition of steam to the reaction in downflow reactor 104 enhances light olefin production via cracking middle-distillate and saturated paraffins. The use of a downflow reactor prevents back mixing and over cracking of reaction products, while the use of a high catalyst/oil ratio ensures catalytic cracking is predominant. While high temperature favors the formation of useful reaction intermediates such as light olefins, short contact time prevents secondary reactions which are responsible for the consumption of the useful intermediates.

The expected ethylene-plus-propylene yield in some embodiments is at least about 40% or at least about 30%, with a reduction in the production of dry gas, for example hydrogen, methane, and ethane. The steam-to-hydrocarbon weight ratio is a function of the feedstock as well as a compromise between the yield structure (olefin selectivity) and type of catalyst used. For a downflow reactor in some embodiments of the present disclosure, the residence time is expected to be between about 0.5 seconds to about 1.5 seconds. The amount of steam used is also a function of the type of feedstock hydrocarbon as well as a compromise between the yield structure (olefin selectivity) and type of catalyst used.

In embodiments of the present disclosure, FCP units are operated at temperatures in the range of between about 500° C. to about 700° C. Under these reaction temperatures, steam assists in the catalytic cracking, while minimizing the formation of coke on the catalyst particles. As noted, when applying downer technology in embodiments of the present disclosure, the residence time in the downflow reactor is short, for example about between about 0.5 to about 1.5 seconds, and this will prevent over cracking and dry gas formation, which are often encountered with other riser technologies due to longer residence times.

Embodiments of systems and methods of the present disclosure operate at high catalyst to oil ratios (C/O), for example in the range of about 15 to about 25 to recompense for the decrease in conversions due to the short contact time. An advantage of operation at high C/O ratios is the enhanced contribution of catalytic cracking over thermal cracking and to maintain the heat balance.

Micro-activity tests have been conducted to show the effect of steam on conversion and product distribution. The results of Table 1 show that the catalyst is stable and active even after 100 hours of operation. This is indicative of the catalyst performance in fluidized beds in which reaction time is in seconds. According to Table 1, a suitable catalyst can undergo several operations before it deactivates.

TABLE 1

Dodecane conversion at 350° C. and 10% steam over Catalyst.

| | | Selectivity | | | | |
|---|---|---|---|---|---|---|
| Hours | Conversion, vol % | Naphthenes Vol % | Paraffins Vol % | I-Parraffins Vol % | Aromatics Vol % | Olefins Vol % |
| 1 | 79.9 | 3.37 | 32.98 | 21.83 | 6.36 | 38.01 |
| 2 | 76.0 | 3.45 | 31.10 | 23.24 | 8.08 | 33.23 |
| 3 | 72.9 | 3.30 | 33.01 | 24.14 | 7.46 | 34.89 |
| 4 | 68.1 | 3.34 | 32.24 | 24.06 | 8.20 | 35.15 |
| 5 | 70.6 | 3.16 | 32.62 | 24.54 | 6.88 | 35.68 |
| 25 | 66.1 | 3.10 | 32.64 | 22.67 | 5.76 | 38.91 |
| 56 | 61.5 | 2.86 | 33.02 | 20.79 | 4.78 | 41.86 |
| 101 | 41.3 | 3.60 | 31.54 | 23.35 | 3.10 | 43.35 |

The singular forms "a," "an," and "the" include plural referents, unless the context clearly dictates otherwise.

In the drawings and specification, there have been disclosed embodiments of apparatus, systems, and methods for fluidized catalytic pyrolysis, as well as others, and although specific terms are employed, the terms are used in a descriptive sense only and not for purposes of limitation. The embodiments of the present disclosure have been described in considerable detail with specific reference to these illustrated embodiments. It will be apparent, however, that various modifications and changes can be made within the spirit and scope of the disclosure as described in the foregoing specification, and such modifications and changes are to be considered equivalents and part of this disclosure.

The invention claimed is:

1. A system for steam and catalytic cracking of a hydrocarbon inlet stream comprising hydrocarbons, the system comprising:

a catalyst feed stream, where the catalyst feed stream comprises a fluid and a heterogeneous catalyst, the heterogeneous catalyst operable to catalyze cracking of the hydrocarbons on surfaces of the heterogeneous catalyst, and the hydrocarbons comprising a crude oil feed;

a steam feed stream, where the steam feed stream is operable to effect steam cracking of the hydrocarbons, where the steam feed stream decreases coking of the heterogeneous catalyst, and where the steam feed stream comprises a recycle steam stream;

a mixing zone for atomization of the hydrocarbon inlet stream with the steam feed stream, where a catalyst feed stream inlet to the mixing zone precedes a steam feed stream inlet to the mixing zone, and where the steam feed stream inlet to the mixing zone precedes a hydrocarbon inlet stream to the mixing zone, and where the steam feed stream can be injected directly and separately to the mixing zone before, simultaneous with, or before and simultaneous with the hydrocarbon inlet stream and the catalyst feed stream; and a downflow reactor, where the downflow reactor is operable to accept and mix the hydrocarbon inlet stream, the catalyst feed stream, and the steam feed stream, where the downflow reactor is operable to produce light olefins by steam cracking and catalytic cracking, where the total amount of steam supplied to the downflow reactor enhances light olefin yield from the hydrocarbon inlet stream effecting steam catalytic cracking resulting in a product stream comprising ethylene and propylene with a total yield of ethylene and propylene together at about at least 20% from the crude oil feed, and where the downflow reactor is operable to allow the heterogeneous catalyst to flow downwardly by gravity.

2. The system according to claim 1, where the downflow reactor operates in a temperature range between about 500° C. to about 700° C.

3. The system according to claim 1, further comprising a catalyst hydrocarbon stripper with structured packing, where the catalyst hydrocarbon stripper is operable to remove hydrocarbons adsorbed to the heterogeneous catalyst by applying steam.

4. The system according to claim 3, where the recycle steam stream comprises steam used in the catalyst hydrocarbon stripper with structured packing to remove hydrocarbons adsorbed to the heterogeneous catalyst.

5. The system according to claim 4, further comprising a catalyst regenerator operable to regenerate spent heterogeneous catalyst through combustion of coke disposed on the heterogeneous catalyst.

6. The system according to claim 5, where the catalyst feed stream comprises new, unused heterogeneous catalyst and regenerated catalyst from the catalyst regenerator.

7. The system according to claim 1, where a yield of light olefins from the hydrocarbon inlet stream is at least about 30%.

8. The system according to claim 1, where the system is operable to accept the steam feed stream when the steam feed stream is greater than about 3% by weight of the hydrocarbon inlet stream.

9. The system according to claim 1, where the system is operable to accept the steam feed stream when the steam feed stream is between about 5% by weight and about 15% by weight of the hydrocarbon inlet stream.

10. The system according to claim 1, where the system is operable to accept the steam feed stream when the steam feed stream is about 10% by weight of the hydrocarbon inlet stream.

11. The system according to claim 1, where the residence time of the downflow reactor prevents secondary reactions responsible for the consumption of the light olefins.

* * * * *